US007161536B2

(12) United States Patent
Hilgers

(10) Patent No.: US 7,161,536 B2
(45) Date of Patent: Jan. 9, 2007

(54) GPS RECEIVER MODULE

(75) Inventor: Achim Hilgers, Alsdorf (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 84 days.

(21) Appl. No.: 10/530,377

(22) PCT Filed: Sep. 29, 2003

(86) PCT No.: PCT/IB03/04270

§ 371 (c)(1),
(2), (4) Date: Apr. 6, 2005

(87) PCT Pub. No.: WO2004/034513

PCT Pub. Date: Apr. 22, 2004

(65) Prior Publication Data

US 2006/0046673 A1 Mar. 2, 2006

(30) Foreign Application Priority Data

Oct. 10, 2002 (DE) ..... 102 47 297

(51) Int. Cl.
*H01Q 1/38* (2006.01)

(52) U.S. Cl. ..... 343/700 MS; 343/702

(58) Field of Classification Search ..... 343/700 MS, 343/702, 846
See application file for complete search history.

(56) References Cited

U.S. PATENT DOCUMENTS 6,680,700 B1 * 1/2004 Hilgers ..... 343/700 MS
6,683,571 B1 * 1/2004 Ghosh et al. ..... 343/700 MS
6,683,576 B1 * 1/2004 Achim ..... 343/702
6,759,988 B1 * 7/2004 Purr et al. ..... 343/700 MS
6,836,645 B1 * 12/2004 Hilgers et al. ..... 455/84

FOREIGN PATENT DOCUMENTS

GB 2359929 A 9/2001

* cited by examiner

*Primary Examiner*—Hoang V. Nguyen
(74) *Attorney, Agent, or Firm*—Aaron Waxler; Paul Im

(57) ABSTRACT

The invention relates to a receiver module (1), more particularly a GPS (Global Positioning System) receiver module for receiving PS signals and for determining position data therefrom, as well as a dual band antenna (2) for such a receiver module (1). The dual band antenna (2) has at least a first and a second resonant printed wire structure (11 and 12) which are a first junction point (10) to a first printed wire (24) on a printed circuit board (7). Additionally, at least a second and wire (25 and 29) are provided on the printed circuit board (7) as connections to the antenna. The invention further relates t circuit board (PCB) as well as a mobile telecommunications device having such a dual band antenna.

8 Claims, 2 Drawing Sheets

GPS RECEIVER MODULE

This application is a 371 of PCT/IB03/04270 dated Oct. 29, 2003.

The invention relates to a receiver module, more particularly a GPS (Global Positioning System) receiver module for receiving GPS signals and for determining position data therefrom, and to a dual band antenna for such a receiver module. The invention further relates to a printed circuit board (PCB) as well as a mobile telecommunication device having such a dual band antenna.

As is well known, GPS signals serve for global position finding and navigation and are emitted by a network of satellites totaling 24 satellites, which circle the Earth on different orbits, so that at least five satellites are visible at any point on the Earth's surface at any one time.

The positioning is based on the principle of a transit time measurement of signals, which are modulated on electromagnetic carrier waves with a carrier frequency of 1575.42 MHz. The signals emitted by the satellites are time-synchronized and consist of two parts. A first part contains the respective satellite positions and the time with which a clock in the GPS receiver is synchronized. From the second part, the GPS receiver determines the orbit data of the satellites that can be received at that instant. The position of the GPS receiver is calculated from these.

GPS receiver modules which contain the receiving and evaluation electronics needed for this are already known. Depending on the purpose for which the module is intended, the position data are either delivered to an interface for further processing in other units, or the module has an integral display unit for the position data. Modules of this type are built into mobile and fixed navigation equipment for applications in aviation, shipping and road traffic.

Since the GPS modules are becoming ever smaller and thus expensive, efforts are also being made to fit these into appliances that do not typically serve for navigation purposes, such as mobile telephones, portable computers and wrist watches, for example. The integration of a GPS module into such an appliance, however, in many cases also calls for extensive intervention in the electronics of the appliance itself where, for example, inputs to the GPS module are to be made via a key pad of the appliance or position data are to be shown on a display of the appliance.

A GPS module dual band antenna provided for this purpose is to be capable of establishing a communication connection to said appliances. For this purpose it should not only be capable of receiving GPS signals, but also capable of sending and receiving signals such as Bluetooth signals in higher frequency ranges. For filtering the signals the antenna is customarily followed by a passive filter element (for example diplex filter) or an active switching element.

The invention has for an object to provide a receiver module having a filter functionality integrated with the antenna.

The object is achieved by a receiver module having an antenna in which at least a first and a second resonant printed wire structure are connected via a first junction point to a first printed wire on a printed circuit board and at least a second and a third printed wire are provided on the printed circuit board as connections to the antenna.

An advantage of this solution comprises that a sufficient filter functionality is ensured between a first and a second frequency band. In this way, electronics such as a diplex filter for filtering the signal and following the antenna is no longer necessary. For mass production of the receiver module the manufacturing costs can thus be reduced considerably.

With the embodiment as claimed in claims 2 to 4 the first printed wire is connected to a ground potential of the printed circuit board. At the same time the second printed wires on the printed circuit board are connected to a third printed wire structure of the antenna via a second junction point. The third printed wire is brought into contact with the antenna via a third junction point. Both the second and the third printed wires are provided as high frequency supply lines.

The first and second printed wire structures commence at a first junction point and end each at a separate end point. The individual length ($l_i$) of a single printed wire structure substantially corresponds to half the wavelength of the resonant frequency ($f_i$). The individual length ($l_i$) is approximately:

$$l_i \cong \frac{\lambda_i}{2\sqrt{\varepsilon_r}}$$

Furthermore, the invention relates to an antenna with a substrate. The antenna comprises at least a first and a second resonant printed wire structure, which are connected via a first junction point to a first printed wire on a printed circuit board. The antenna has at least two further junction points via which the two further printed wires on the printed circuit board are arranged as connections to the antenna.

The invention further relates to a printed circuit board more particularly for surface mounting electronic components, and a telecommunication appliance having such an antenna.

The invention will be further described with reference to examples of embodiments shown in the drawings to which, however, the invention is not restricted, and in which.

Figure 1:
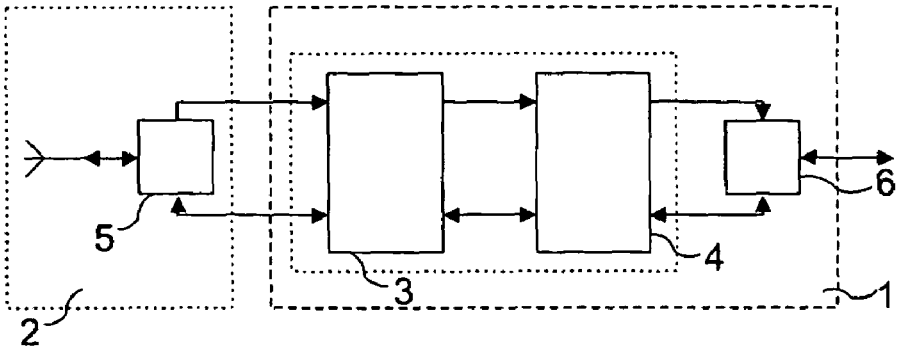
FIG. 1 shows a schematic representation of a GPS receiver module.

FIG. 1 shows a first embodiment of the GPS receiver module 1 according to the invention having a dual band antenna 2. The dual band antenna 2 is provided with an integrated filter functionality schematically shown by block 5. Furthermore, the dual band antenna is connected to the GPS receiver module via two links, one of the links being a bidirectional link. The GPS receiver module 1 contains a HF sub-module 3 used in common for GPS signals and Bluetooth (BT) signals, and also a common baseband sub-module 4.

The HF sub-module 3 is provided for receiving and converting GPS signals into low-frequency position signals and also for receiving and transmitting BT signals. The baseband sub-module 4 connected to the HF sub-module 3 via a first link converts the position signals into position data which can be evaluated by a user. For this purpose various signal processing methods are known, which will not be further discussed here.

In addition, the baseband sub-module 4 comprises a second, bidirectional link to the HF sub-module 3, over which the BT signals to be transmitted or received can be exchanged. These signals are therefore coded or decoded, respectively according to the BT standard in the baseband sub-module 4 and also compressed or decompressed as required. For this purpose too signal processing methods are known which will not be further discussed here.

The GPS receiver module 1 has an interface circuit 6 which is connected to the baseband sub-module 4 via two links. A first link is used for transmitting the user-assessable position data to the interface circuit 6 and via a second bidirectional link information is transmitted for coding into the Bluetooth standard or for the decoded information, respectively. Other appliances can be bidirectionally connected via the interface circuit 6 by means of the external wire link.

In this way GPS signals can be received, converted and transformed into position data by the GPS receiver module 1, which data are then applied to the baseband sub-module 4 and the HF sub-module 3 via the interface circuit 6 so as to transmit these data after the transformation into signals coded according to the BT standard to another appliance via the antenna 2 (for example a computer, a mobile telephone etc.), which has an interface for receiving and decoding BT-coded signals.

As an alternative, the position data can also be applied via the interface circuit 6 to such appliances (for example a display unit) that do not have a Bluetooth interface.

Furthermore, via the antenna 2 and also via the second, bi-directional link, Bluetooth signals from other appliances can be received which are then converted into a baseband, decoded and applied via the interface circuit 6 and the external wire link to a connected appliance for control and/or data transmission. The interface circuit 6, on the other hand, can also be provided for wire-bound transmission of data from an external appliance to the baseband sub-module 4.

Figure 2:
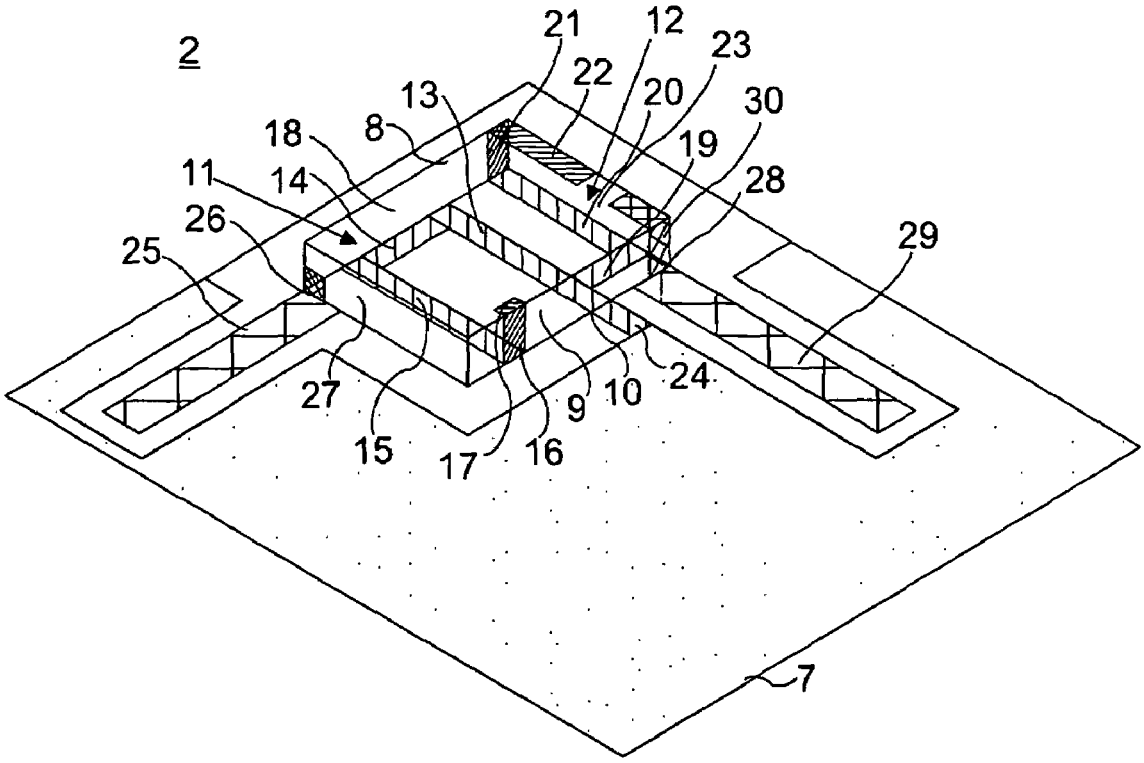
FIG. 2 shows a printed circuit board with an embodiment of a dual band antenna according to the invention.

FIG. 2 shows a printed circuit board 7 with the antenna 2. The antenna 2 is soldered with various solder points not shown here by use of the surface mounting technique (SMD) on the printed circuit board 7. This antenna is basically a printed wire antenna in which one or several printed wires are deposited on a substrate. In principle, these antennas are wire antennas which, contrary to the microstrip line antennas, have no metallic surface on the backside of the substrate which surface forms a reference potential.

The antenna 2 comprises a ceramic substrate 8 in the form of an in essence rectangular block whose height is smaller by a factor from 3 to 10 than its length or width. Instead of the rectangular substrate 8 it is also possible to use other geometrical forms such as, for example, a cylindrical form on which respective printed wire structures are deposited.

The substrates can be manufactured by embedding a ceramic powder in a polymer matrix and have a relative permitivity of $\epsilon_r>1$ and/or a relative permeability of $\mu_r>1$.

Based on this, in the following description the substrate surface shown in FIG. 2 as the upper or lower (large) surface is referred to as first upper or second lower end face, respectively, and the opposite vertical surfaces (circumference of the substrate) as first to fourth side faces.

On the lower end face in the area of the middle of a first side face 9 there is a first junction point 10 from where two resonant printed wire structures 11 and 12 are running, in essence, on the lower end face. With regard to their resonant lengths, the first printed wire structure 11 is tuned to the frequency band of the GPS signals and the second printed wire structure 12 to the frequency band of the BT signals. The width of all printed wire structures on the antenna 2 is about 1 mm.

The first printed wire 11 is, in essence, subdivided into five printed wire sections 13 to 17. The first printed wire section 13 runs rectilinearly from junction point 10 to a second side face 18 lying opposite the first side face 9. A second printed wire section 14 starts from the first printed wire section 13 and extends along the side of the second side face 18. Perpendicularly to the second printed wire section 14 runs a third printed wire section 15, which is arranged substantially parallel with the first printed wire section 13 and ends at the first side face 9. To the third printed wire section on the first side face 9 and perpendicularly to the printed circuit board surface is connected a fourth printed wire section 16. It ends in a short printed wire section 17 on the upper end face.

At about a quarter of the length of the printed wire section 13 from junction point 10 onwards the second printed wire structure 12 extends perpendicularly to the printed wire section 13. The second printed wire structure 12 is formed by four printed wire sections 19 to 22. A first printed wire section 19 extends substantially perpendicularly from the printed wire section 13 to a lower edge of a third side face 23. A second printed wire section 20 joins the first printed wire section 19 and runs along the lower edge of the third side face 23 in the direction of and up to the second side face 18. Starting from the end of the second printed wire section 20 a third printed wire section 21 extends over the total height of the second side face 18. The second printed wire structure 12 ends in a fourth printed wire section 22 which joins the third printed wire section and runs on the upper end face along the third side face 23.

Both the first printed wire structure 11 and the second printed wire structure 12 are connected via the first junction point 10 to a first printed wire 24 on the printed circuit board 7. The printed wire 24 is again connected to a ground potential of the printed circuit board. Its width is about 1 mm and its length is 2 mm.

The antenna 2 is connected via a second junction point 28 to a second printed wire 29. The second junction point 28 is located on a lower edge of the first side face 9 opposite to the first printed wire section 19 of the second printed wire structure 12. Starting from the second junction point 28 runs a printed wire 30 over the total height of the first side face 9 and extends with a length of about 2 mm across the upper end face of the substrate. The second junction point 28 and the second printed wire 29 form a 50 Ω connection for the BT signal path.

A third printed wire 25 on the printed circuit board 7 is connected to the antenna 2 via a third junction point 26. The third junction point 26 is located on the lower edge of a fourth side face 27 and serves in common with the printed wire 25 as a 50 Ω connection for the GPS signal path.

In essence, the mutual distance of the first and the second printed wires 25 and 29 determines the isolation of the signals. The width of the first and second printed wires 25 and 29 on the printed circuit board 7 is about 1.8 mm.

Figure 3:
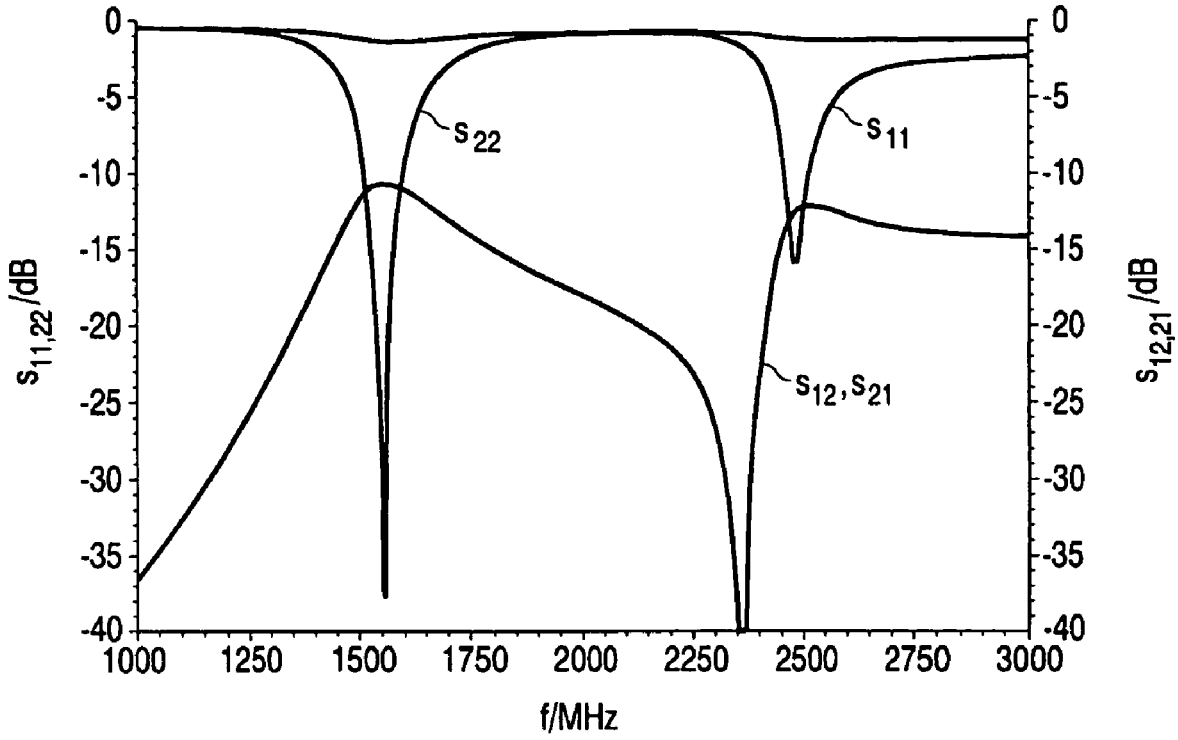
FIG. 3 shows an impedance spectrum of the antenna shown in FIG. 3.

FIG. 3 shows the pattern of the impedances of such an antenna. Input reflections on the third printed wire 25 ($s_{22}$) provided for the GPS signal path and of the second printed wire 29 ($s_{11}$) provided for the BT signal path, as well as the transmission or isolation respectively between the two printed wires ($S_{21}$, $S_{12}$) are plotted against frequency.

For the GPS frequency (1.573 GHz) the receiving module shows on the GPS printed wire 25 ($s_{22}$) an adaptation of about −35 dB, as against which an adaptation of only about −1 dB on the BT printed wire 29 ($s_{11}$) was measured. The intermediate frequency of the BT band (2.442 GHz) is adapted to the BT printed wire 29 ($s_{11}$) by about −15 dB, the GPS printed wire 25 ($s_{22}$) shows only an adaptation of about −1 dB at this frequency. This leads to the fact that there is strong isolation between the two printed wires 25 and 29

(GPS-BT). This is always less than −10 dB over the measured frequency range from 1 to 3 GHz.

The invention claimed is:

1. A receiver module (1) having an antenna (2), in which at least a first and a second resonant printed wire structure (11 and 12) are connected to a first printed wire (24) on a printed circuit board (7) via a first junction point (10), and at least a second and a third printed wire (25 and 29) are provided on the printed circuit board (7) as connections to the antenna.

2. A receiver module as claimed in claim 1, characterized in that the first printed wire (24) is connected to a ground potential of the printed circuit board (7).

3. A receiver module as claimed in claim 1, characterized in that the second and third printed wires are provided as high-frequency supply lines.

4. A receiver module as claimed in claim 1, characterized in that the second printed wire (29) on the printed circuit board (7) is connected via a second junction point (28) to a third printed wire (30) of the antenna.

5. A receiver module as claimed in claim 1, characterized in that the length of the first resonant printed wire structure (11) is tuned to a first frequency band and the length of the second resonant printed wire structure (12) is tuned to a second frequency band.

6. An antenna (2) comprising a substrate (8) that has at least a first and a second resonant printed wire structure (11 and 12) which are connected via a first junction point (10) to a first printed wire (24) on a printed circuit board (7) and has at least two further junction points (26 and 28) via which two further printed wires (25 and 29) on the printed circuit board (7) are provided as connections to the antenna.

7. A printed circuit board (7) more particularly for surface mounting of electronic components, having an antenna (2) as claimed in claim 6.

8. A telecommunications device having an antenna (2) as claimed in claim 6.

* * * * *